US005720658A

United States Patent [19]

Belusa

[11] Patent Number: 5,720,658

[45] Date of Patent: Feb. 24, 1998

[54] SPACE PRESSURIZATION CONTROL SYSTEM FOR HIGH CONTAINMENT LABORATORIES

[76] Inventor: Manfred L. Belusa, 59 Ravensbourne Cres., Toronto, Ontario, Canada, M9A 2A9

[21] Appl. No.: 441,494

[22] Filed: May 15, 1995

Related U.S. Application Data

[63] Continuation of Ser. No. 72,307, Jun. 9, 1993, abandoned, which is a continuation-in-part of Ser. No. 833,690, Feb. 11, 1992, abandoned.

[51] Int. Cl.[6] ..... F24F 11/00

[52] U.S. Cl. ..... 454/238; 454/229; 454/255

[58] Field of Search ..... 454/49, 56, 61, 454/229, 238, 255

[56] References Cited

U.S. PATENT DOCUMENTS

| | | | |
|---|---|---|---|
| 3,402,654 | 9/1968 | Berst | 454/238 X |
| 3,766,844 | 10/1973 | Donnelly et al. | 454/255 X |
| 4,428,529 | 1/1984 | Bentsen | 454/238 |
| 4,485,729 | 12/1984 | Crittenden et al. | 454/238 |
| 4,705,457 | 11/1987 | Belusa | 454/251 |
| 4,773,311 | 9/1988 | Sharp | 454/56 |
| 5,115,728 | 5/1992 | Ahmed et al. | 454/61 |

*Primary Examiner*—Harold Joyce
*Attorney, Agent, or Firm*—Ridout & Maybee

[57] ABSTRACT

An apparatus and method for space pressure control in high containment laboratories. The system comprises a volumetric air flow controller and a differential pressure controller. The differential pressure controller couples to the volumetric air flow controller. To establish negative space pressurization in the laboratory, the differential pressure controller generates a variable offset signal for volumetric operation. In response to the offset signal, the volumetric air controller controls the ducted supply air to the laboratory at a set shortfall compared to the ducted exhaust air flow. The shortfall of ducted supply air creates a negative pressure which is also sensed by the differential pressure controller. The differential pressure controller reduces the variable offset signal to zero once the desired negative pressure level is attained. To maintain the negative pressure level, the supply and exhaust air flow rates must remain equal. Any change in the negative pressure level is detected by the differential pressure controller which will generate the offset signal required to restore the negative pressure level. Furthermore, if the negative pressure level is completely lost, either by breach of the laboratory containment barrier or by equipment failure, then the system will automatically revert to volumetric operation using the offset signal.

13 Claims, 5 Drawing Sheets

SPACE PRESSURIZATION CONTROL SYSTEM FOR HIGH CONTAINMENT LABORATORIES

This application is a continuation of my application Ser. No. 072,307 filed Jun. 9, 1993 abandoned entitled Space Pressurization Control System for High Containment Laboratories which is a continuation-in-part of application Ser. No. 833,690 filed Feb. 11, 1992 abandoned and entitled Method and Apparatus for Space Pressure Control in Laboratories.

FIELD OF INVENTION

This invention relates to laboratory ventilation control systems. More particularly, it provides a system for space pressure and ventilation control which is suitable for high containment laboratories.

BACKGROUND OF THE INVENTION

Research laboratories are classified according to the type of activity which will be conducted in them. For example, in a biomedical research laboratory, the type of virus, germ, or other bacterial agent handled in the laboratory will dictate the degree of "containment" which is required.

The degree of containment for a biomedical research laboratory is classified from Level 1 to Level 4 by guidelines which are issued by the National Institute of Health in the United States (and the Medical Research Council of Canada in Canada). A Level 1 containment biomedical laboratory is a general purpose laboratory which handles substances posing minimal risk to the researcher or the surrounding environment, whereas a Level 4 facility is classified to handle the most deadly substances known to mankind. The guidelines outline the minimum requirements to protect the researchers working in the laboratories and the community and environment surrounding the laboratory.

To prevent the release of bacteriological agents from one laboratory into another, or to the outside environment, it is usually a requirement to maintain the laboratory space at a negative pressure with respect to adjoining spaces. The higher containment laboratories, e.g. Level 3 and 4, in a building are normally surrounded by lower containment facilities. Since the highest containment facility requires the greatest degree of safety (i.e. containment), the highest containment level is maintained at the greatest negative pressure. This usually results in several levels of negative pressurization.

Laboratories typically contain exhaust elements to allow handling of harmful materials. The exhaust elements include fume hoods, biological safety cabinets, and laminar flow cabinets. The fume hood, for example, is a ventilated enclosure where harmful materials can be handled safely. The hood captures contaminants and prevents them from escaping into the laboratory by using an exhaust blower to draw air and contaminants in and around the hood's opening away from the laboratory researcher or operator so that inhalation and contact with the contaminants are minimized. Similarly, the biological safety cabinet is a safety device which provides protection to the laboratory researcher and/or the surrounding environment. In addition, some classes of biological safety cabinets minimize the contamination of the agent under investigation.

To provide protection to the researcher from harm in case of a spill or when handling agents, certain minimum ventilation rates are suggested. These ventilation rates are usually expressed in terms of Air Changes per Hour (ACH). They are the minimum rates at which the laboratory space must be ventilated to provide desired dilution in case of a spill of the agent, or to keep the exposure levels to bacteriological agents below certain specified levels.

It is sometimes desirable to reduce the ventilation rates, e.g. when the laboratory is unoccupied, however, the space pressurization levels must still be maintained to provide containment. Space pressurization in a laboratory is controlled by varying the supply air flow, the exhaust air flow (or sometimes both) in relation to each other.

The exhaust air flow rate is dependent on the flow rate in the ventilation ducts in addition to the exhaust flow through safety devices such as fume hoods, laminar flow cabinets, biological safety cabinets and the like located inside the laboratory. The air which is exhausted from the laboratory is made up by supply (or make-up) air which is usually supplied through a heating, ventilation, and air conditioning (HVAC) system. There will be negative pressurization if the supply air flow rate is at a shortfall compared to the total exhaust air flow rate. To maintain the negative pressure level, the volume of make-up air supplied by the HVAC system must vary as the exhaust air flow levels vary through the operation of the fume hoods and other safety devices.

It is the difference between the supply and exhaust air flow rates that creates the space pressurization level. If the supply air flow rate exceeds the exhaust air flow rate, then the space pressurization level will be positive, i.e. the laboratory space will have a positive pressure with respect to an adjoining reference space. On the other hand, if the supply air flow rate is less than the exhaust air flow rate (i.e. at a shortfall), then the laboratory space will have a negative pressure. In a general purpose or low containment laboratory facility, the difference between the supply and exhaust air flows is made up by air which leaks through the structure that encloses the laboratory space. For example, in a low containment laboratory air will enter or leak into the laboratory space through cracks around the door or windows, or through gaps around pipes or ducts which are run into the laboratory space.

In the prior art, two methods of space pressure control (i.e. negative pressurization) have been used for low containment or "leaky" laboratory facilities. They are known as the differential pressure control method and the volumetric offset method.

The differential pressure control method involves measuring the differential pressure between the laboratory space and a reference space. To achieve negative space pressurization, the exhaust air flow rate (or supply air flow rate) is varied in response to the measured difference between the laboratory pressure level and the reference pressure level. For example, if the laboratory pressure level rises with respect to the reference pressure level, then the exhaust air flow rate is increased to exhaust more air thereby reducing the pressure inside the laboratory.

The differential pressure control method can maintain the negative space pressure level, however, the reference space must be carefully selected. For example, if the reference space is selected to be the corridor adjacent to the laboratory space and the door (connecting the laboratory space to the reference space) is propped open, then the pressure differential will be zero, and it will be impossible to achieve negative space pressurization until the door is closed. Since it is desirable to have the laboratory pressure level lower than the pressure for the adjoining spaces, the corridor is the ideal reference space, but becomes impractical for the differential control method.

In addition, it can be difficult to ensure adequate performance in many installations due to the trade-off which must be made between the response time of the supply air system and the stability of the HVAC system. In the differential pressure method, the air pressure differential which must be sensed is very small, typically on the order of 0.02 inches of water. Such small pressure differentials are difficult to sense and will contain a lot of "noise" caused by small variations in the pressure drops through the ducting and other parts of the HVAC system as the HVAC system changes air flows to various other parts of the building during normal operation. Long time lags and filters are typically used to smooth out these variations. In some installations, large oscillations in air flows may result from changes in the system, such as when a door is opened, which in the worst case may become unstable, if such filtering is not used.

Because of these difficulties, the volumetric offset method has been more widely used for space pressure control of low containment laboratories. Negative space pressurization is achieved by running the supply air flow rate at a shortfall in relation to the exhaust air flow. It will be appreciated by those skilled in the art that the control loop accuracy required for a low containment facility is moderate because any difference between the supply and exhaust air flow rates will be made up by infiltration into the "leaky" laboratory.

Unlike low containment facilities, a high containment laboratory approaches an air-tight chamber, i.e. the infiltration or leakage of air into the laboratory is very low, typically, in the order of much less than 10 percent. The greater the containment required, the tighter the seal to ensure containment of any spills within the laboratory space. The sealed nature of a bottle-tight laboratory also allows decontamination within a controlled space. A typical high containment facility features air-lock entrances, sealed air duct entry points and sealed wall construction.

The laboratory space in a high containment facility must also be maintained at a negative pressure to prevent hazardous materials from escaping into adjoining areas in the building or to the outside environment. In addition, the air control system must have a fast speed of response to provide a degree of containment for catastrophic occurrences, such as a structural breach of the laboratory or failure of the ventilation system.

In a laboratory space which approaches "bottle-tight", the volumetric offset method is ineffective because the offset is cumulative. Any difference between the supply and exhaust air flow rates will result in a cumulative shortfall (or surplus) because very little or no air can leak into the laboratory to counteract the effect of the unequal exhaust and supply air flow rates. However, the volumetric offset method is useful to quickly establish the desired pressure on system start-up, or after a power failure or maintenance shutdown. Once the desired negative space pressurization is attained, the difference in the exhaust and supply air flow rates must be equal to the actual leakage. Since the leakage in a high containment laboratory is by definition very low when compared to the ventilation levels, maintaining the space pressure level becomes a control issue.

In the differential pressure control technique, negative pressurization is achieved by sensing the pressure difference between the laboratory and a reference space and using the pressure difference to control the ducted supply air flow, while keeping the total ducted exhaust air flow constant, or vice versa, as discussed above. The differential pressure controller senses the pressure differential and produces a shortfall of supply air flow compared to the total exhaust air flow, where the exhaust flow is the sum of the flow rates of the ventilation ducts, fume hoods, laminar flow cabinets and the like.

Another problem in air-tight enclosures involves pressure fluctuations in the supply or exhaust air systems. The pressure fluctuations in the supply or exhaust air systems can cause oscillations of pressure in the laboratory space. While damping in the control loop can provide stability, it will slow the speed of response thereby preventing the control system from rapidly responding to disturbances or catastrophic events. If there is a breach in the containment barriers of a high-containment facility, the air control system must have an almost instantaneous response to increase the offset between the supply and exhaust air flows to maintain containment during the time the breach is present. In addition, the system should provide sufficient make-up air or supply air that can be drawn through the breach into the laboratory.

BRIEF SUMMARY OF THE INVENTION

The present invention provides a system for controlling the space pressurization of a high containment laboratory, said system comprising: (a) volumetric air flow control means; (b) differential pressure control means, said differential pressure control means being coupled to said volumetric air flow control means, and said differential pressure control means including means for generating a variable offset; and (d) said volumetric air flow control means including means responsive to said variable offset.

In another aspect, the present invention provides a method for controlling space pressure in a room, said method comprising: (a) establishing a space pressure value for the room by controlling air volume flow; and (b) maintaining the established space pressure value in relation to a reference pressure.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION OF THE PREFERRED EMBODIMENTS

Figure 1:
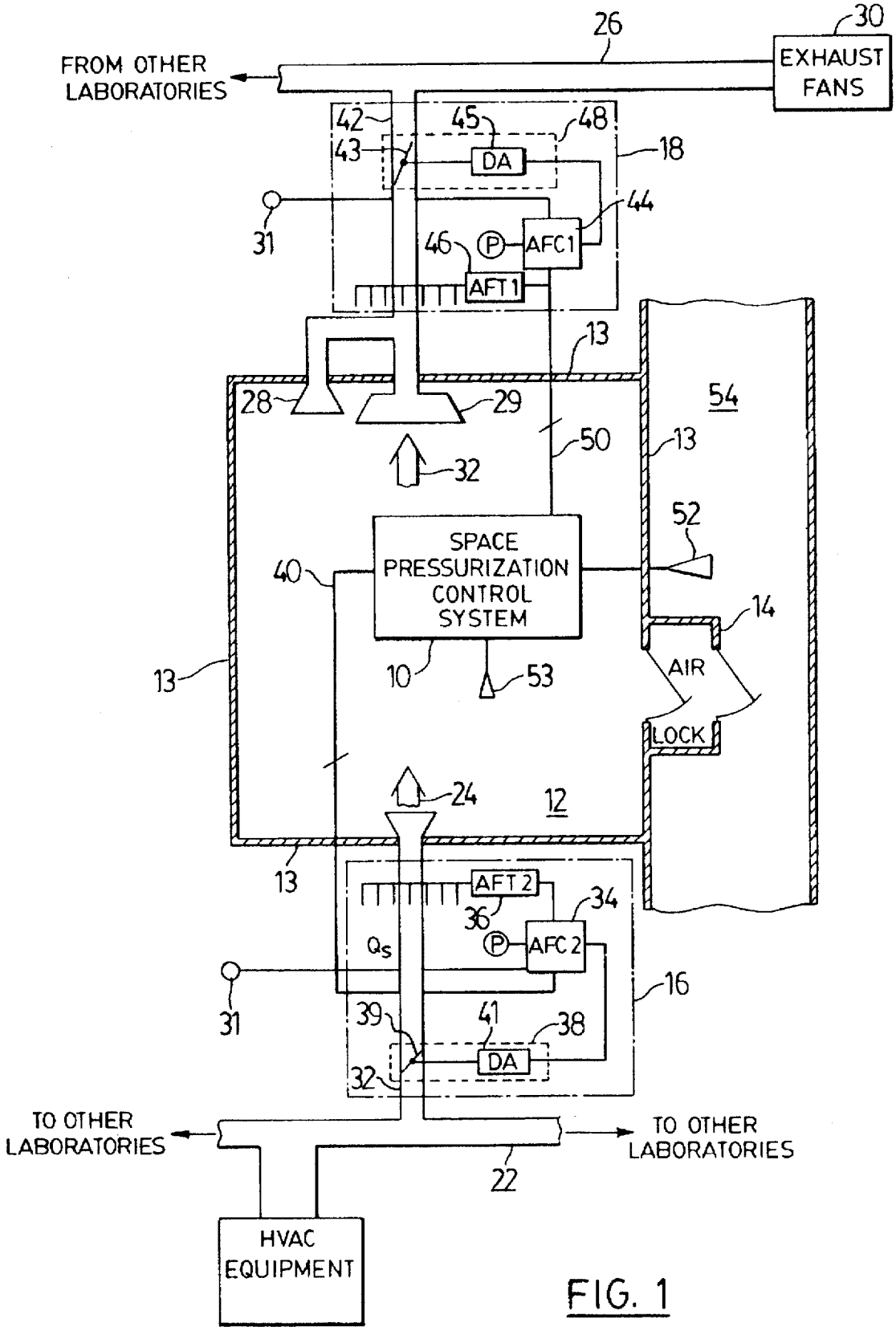
FIG. 1 shows a high containment laboratory with a space pressure control system according to the present invention.

Reference is first made to FIG. 1 which shows a space pressurization control system according to the present invention. The space pressurization control system comprises a space pressure controller 10 which is coupled to the air control system of a high containment laboratory 12.

The high containment laboratory 12 is typically used for processing highly toxic and dangerous substances. To provide containment, the high containment laboratory 12 is designed to provide a sealed space in order to limit the spread of the dangerous substances in case of accidental spillage or for periodic decontamination or sterilization. The laboratory 12 is constructed using known techniques to produce a containment barrier having features such as sealed walls, sealed windows (indicated generally by reference 13) and an air-lock entrance (indicated by reference 14), e.g. a "submarine type" door.

As shown in FIG. 1, the air control system for the laboratory 12 comprises a supply air control system 16 and an exhaust air control system 18. The space pressure controller 10 is coupled to the supply air and exhaust air control systems 16,18 to provide space pressure and ventilation control in a high containment laboratory 12 as will be explained in detail below.

The supply air (or make-up air) control system 16 is coupled to heating cooling and air conditioning. (HVAC) equipment 20 through supply air ducting 22. The function of the supply air system 16 is to provide supply air (indicated by arrow 24) for the laboratory space 12. The supply air 24 is heated or cooled to the desired temperature by the HVAC equipment 20. In known manner, the HVAC equipment 20 may include terminal reheat coils mounted in the supply duct 22.

The function of the exhaust air system 18, on the other hand, is to draw and exhaust air from the laboratory 12. The exhaust air system 18 is coupled to the building's exhaust air ducting 26 and to safety devices 28 and exhaust ventilation outlet(s) 29 which are located in the laboratory 12. The safety devices 28 typically comprise known devices such as fume hoods and laminar flow hoods. The exhaust air system 18 draws or removes an exhaust air volume (indicated by arrow 32) from the laboratory 12 which is then removed by exhaust fans 30 which are coupled to the exhaust ducting 26.

Figure 3:
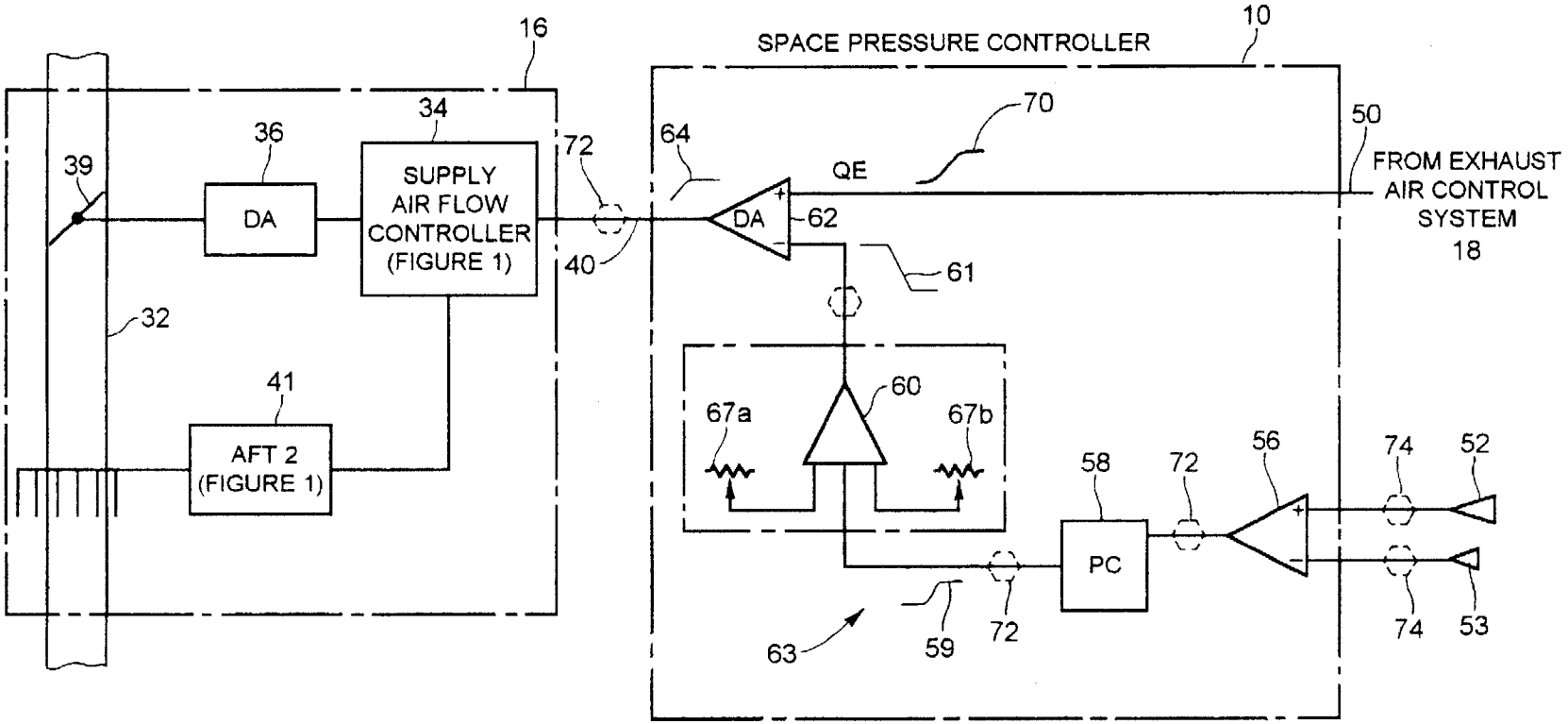
FIG. 3 shows in schematic form the space pressure controller according to the present invention.

Referring to FIG. 1, the supply air control system 16 comprises a supply duct 32, a supply air flow controller 34, an air flow transmitter 36 (or other type of known flow sensor) and a supply air valve 38. The flow of supply or make-up air 24 from the HVAC equipment 20 through the supply duct 32 is controlled in known manner by the air flow controller 34 in response to an air flow control or setpoint signal (FIG. 3) which is dependent on the required ventilation rate, e.g. Air Changes per Hour, or some other normal or emergency mode of operation. The air flow controller 34 is coupled to the supply duct 32 by the air flow transmitter 36 and the supply air valve 38. For the system shown in FIG. 1, the supply air valve 38 comprises a damper 39 and a damper operator 41. The damper 39 is a known physical device, such as the Series MAV Venturi Valve manufactured by Phoenix Controls Corporation of Massachusetts, or any other suitable known air flow control device, for example, a variable speed controller, or a variable air volume box, or an air flow control damper which has been correctly sized as will be understood by one skilled in the art. The function of the damper 39 is to vary the flow of the supply air 24 into the laboratory 12. To provide accurate regulation, the supply or make-up air 24 is sensed by the air flow transmitter 36, which produces a feedback signal (not shown) for use by the air flow controller 34. The signal may be provided by the Phoenix Series MAV Venturi Valve (see above), in which case the air flow transmitter 36 and the damper 39 and damper operator 41 is part of the valve 76, 78 as shown in FIG. 3.

The supply air flow controller 34 is coupled to the space pressure controller 10 through a supply air control interface 40, which provides the interface for controlling and monitoring the supply air control system 16. The space pressurization controller 10 generates an air-flow control signal (indicated by reference 64 in FIG. 3, as will be explained in detail below) which is applied as a set-point signal (or change of set-point signal) to the supply air flow controller 34. In response to the air-flow signal, the supply air flow controller 34 operates the supply air valve 38 to provide the supply air flow 24 required to maintain the negative space pressurization level which is desired for the laboratory 12.

In known manner, the supply air flow controller 34 can be a proportional controller, a proportional controller with integral action, or a proportional with integral and inverse derivative action. The supply air flow controller 34 can be implemented as an analog or digital stand alone system, or as part of a larger distributed digital control system, as will be within the understanding of one skilled in the art.

Referring still to FIG. 1, the primary function of the exhaust air control system 18 is to remove the exhaust air volume 32 in order to maintain the required ventilation rates for the laboratory 12. These ventilation rates are usually expressed in terms of air changes per hour (ACH). They represent the minimum rates at which the laboratory space 12 must be ventilated to provide desired dilution in the case of a spill or to keep the exposure levels of the toxic substances below certain specified levels.

Figure 4:
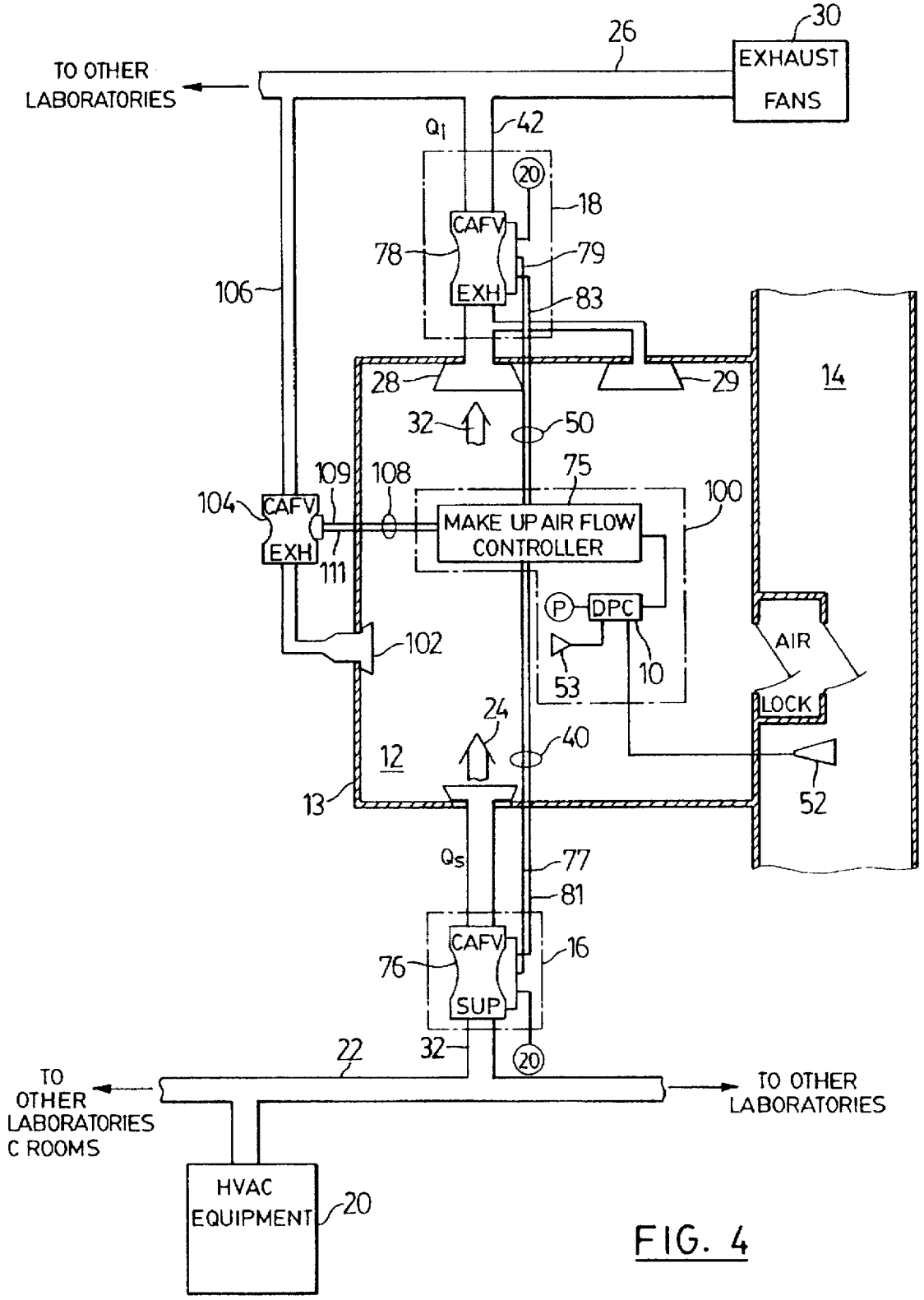
FIG. 4 shows another implementation of a space pressure control system for a high containment laboratory according to the present invention.

The exhaust air control system 18 comprises, as will be understood by one skilled in the art, an exhaust air duct 42, an exhaust air flow controller 44, an air flow transmitter (i.e. sensor) 46, and an exhaust air valve 48. As shown in FIG. 1, the exhaust air valve 48 includes a damper 43 and an actuator 45. Alternatively as shown in FIG. 4, the exhaust valve 78 may be a Series EXV Venturi Valve manufactured by Phoenix Controls Corporation (or a similar device made by other manufacturers) in which case, it may also include the air flow transmitter 46. The exhaust duct 42 couples the safety devices 28 (e.g. fume hoods, biological safety cabinets and laminar floor hoods) and the ventilation outlets 29 to the exhaust air ducting 26. The volume of exhaust air 32 that is drawn by the exhaust air system 18 is then removed by the exhaust fans 30 which are coupled to the exhaust duct 42.

Figure 5:
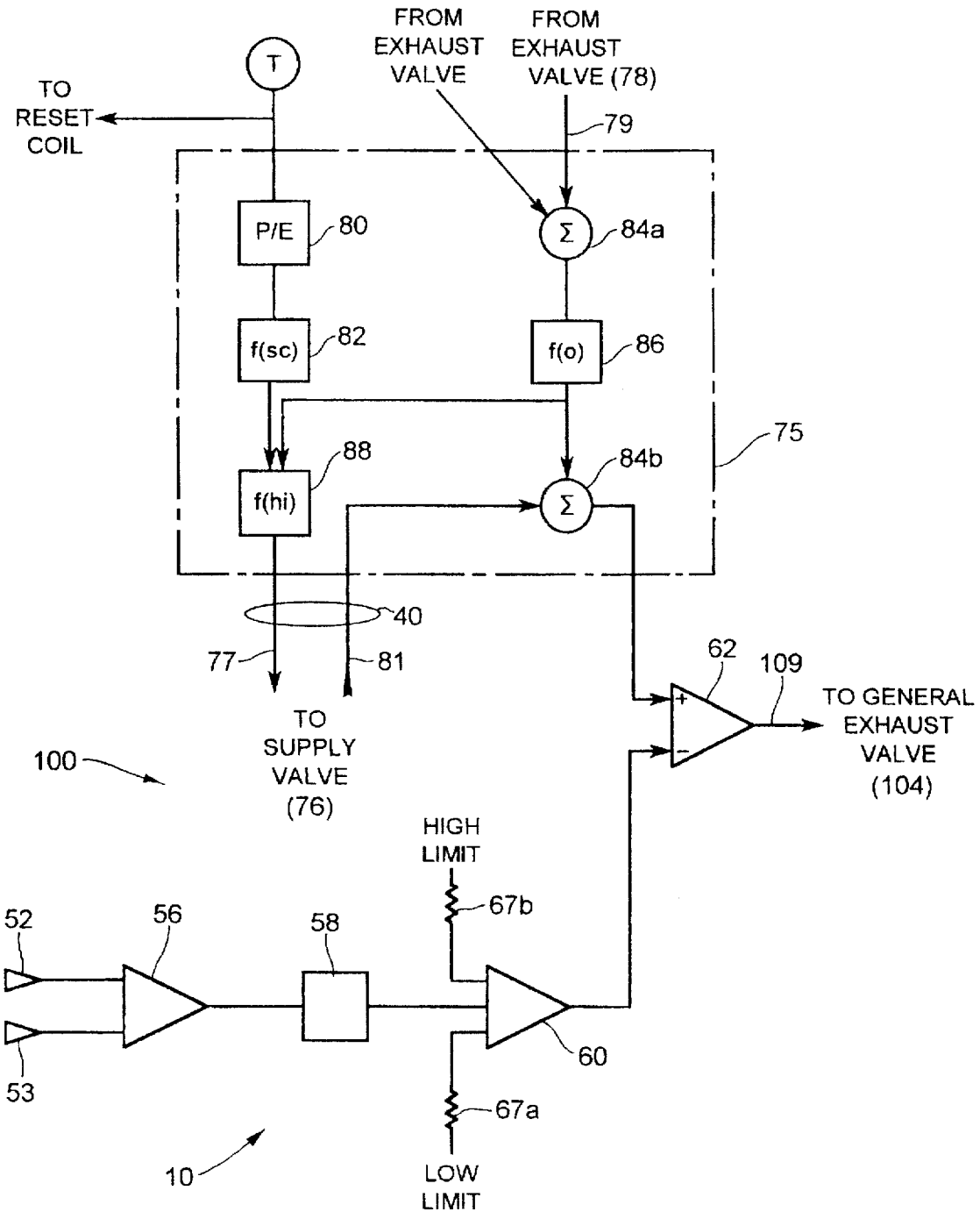
FIG. 5 shows in schematic form the make-up air control panel and space pressure controller for the system of FIG. 4.

The exhaust air control system 18 is coupled to the space pressure controller 10 through an exhaust air control interface 50, which provides the interface for controlling and monitoring the operation of the exhaust air control system 18. It will be appreciated that negative pressurization can also be established by controlling the exhaust air control system 18 to draw more exhaust air 32 then is being supplied (i.e. supply air 24) for low containment spaces and to control the exhaust air 32 equal to the supply air 24 once the desired level of space pressurization has been attained in "bottle tight" high containment laboratories. In FIGS. 4 and 5 below, another embodiment of the present invention is shown which controls the exhaust air flow to provide negative pressurization and containment.

Referring back to FIG. 1, the space pressure controller 10 includes a reference pressure sensing tap 52 and a laboratory space pressure sensing tap 53. (The reference pressure sensing tap 52 and the laboratory pressure sensing tap 53 provide the inputs for a differential pressure transmitter 56 shown in FIG. 3). As will be explained with reference to FIG. 3, the space pressure controller 10 uses the differential pressure transmitter 56 to detect the difference in pressure between the laboratory 12 and the pressure in a reference space 54 (e.g. a corridor adjoining the laboratory 12). The differential pressure transmitter 56 produces an output signal which is proportional to the difference between the two inputs (i.e. sensing taps 52 and 53). The space pressure controller 10 uses the output signal from the pressure transmitter 56 to establish the negative pressurization in the laboratory 12 as will be explained below.

In some facilities, the high containment laboratory 12 may be surrounded by a number of low containment facilities (not shown). Since a high containment laboratory requires the greatest degree of safety, i.e. containment, the high containment laboratory 12 will be maintained at the greatest negative pressure. For the purposes of FIG. 1, the reference space 54 is chosen as the corridor adjacent to the laboratory 12, however, it can also be taken from the outside ambient pressure or any other suitable pressure reference.

The space pressure controller 10 according to the present invention provides a hybrid system that combines the volumetric offset method with the differential pressure control method in order to produce negative pressurization and containment in laboratory spaces where the leakage rate is small.

One of the features of the present invention is that it can provide the rapid response characteristics associated with the volumetric air flow control method, without requiring the precise tolerances normally associated with maintaining the volumetric offset between the supply and exhaust air flow 24,32 control loops that are necessary for a bottle-tight or high containment environment (i.e. a laboratory with lithe or no infiltration). This allows the space pressure controller 10 to quickly establish negative pressurization in the laboratory space 12. Once the negative pressurization level has been established, the space pressure controller 10 utilizes the differential pressure control method to maintain the desired negative pressure level, for example, in response to variations in the system components.

Another feature of the space pressure controller 10 is the capability to function under both normal and emergency conditions. For example, if the containment barrier (i.e. wall 13) is breached, then the negative pressure level will be lost and the space pressure controller 10 will operate the supply air system 16 at the maximum volumetric offset in order to provide containment.

The operation of the space pressure controller 10 according to the present invention can be explained as follows. When first activated, the space pressure controller 10 operates as a volumetric offset air flow controller in a "leaky" room application. Negative pressurization is quickly achieved by operating the supply air control system 16 at a shortfall flow rate, i.e. a flow rate which is less than the flow rate of the exhaust air control system 18. The shortfall rate is dependent on an air-flow control signal 64 (FIG. 3) which is generated by the space pressure controller 10 in response to the readings from sensing taps 52 and 53. The volumetric offset mode of operation quickly achieves the desired initial negative space pressurization to ensure containment. But as the desired negative space pressurization level is reached in the laboratory space 12, the space pressure controller 10 will reduce the shortfall rate (through the air-flow control signal 64), until at the desired level of negative pressure, the air flows of the exhaust and supply control systems 16,18 will be exactly matched. This relationship is illustrated in FIG. 2.

Figure 2:
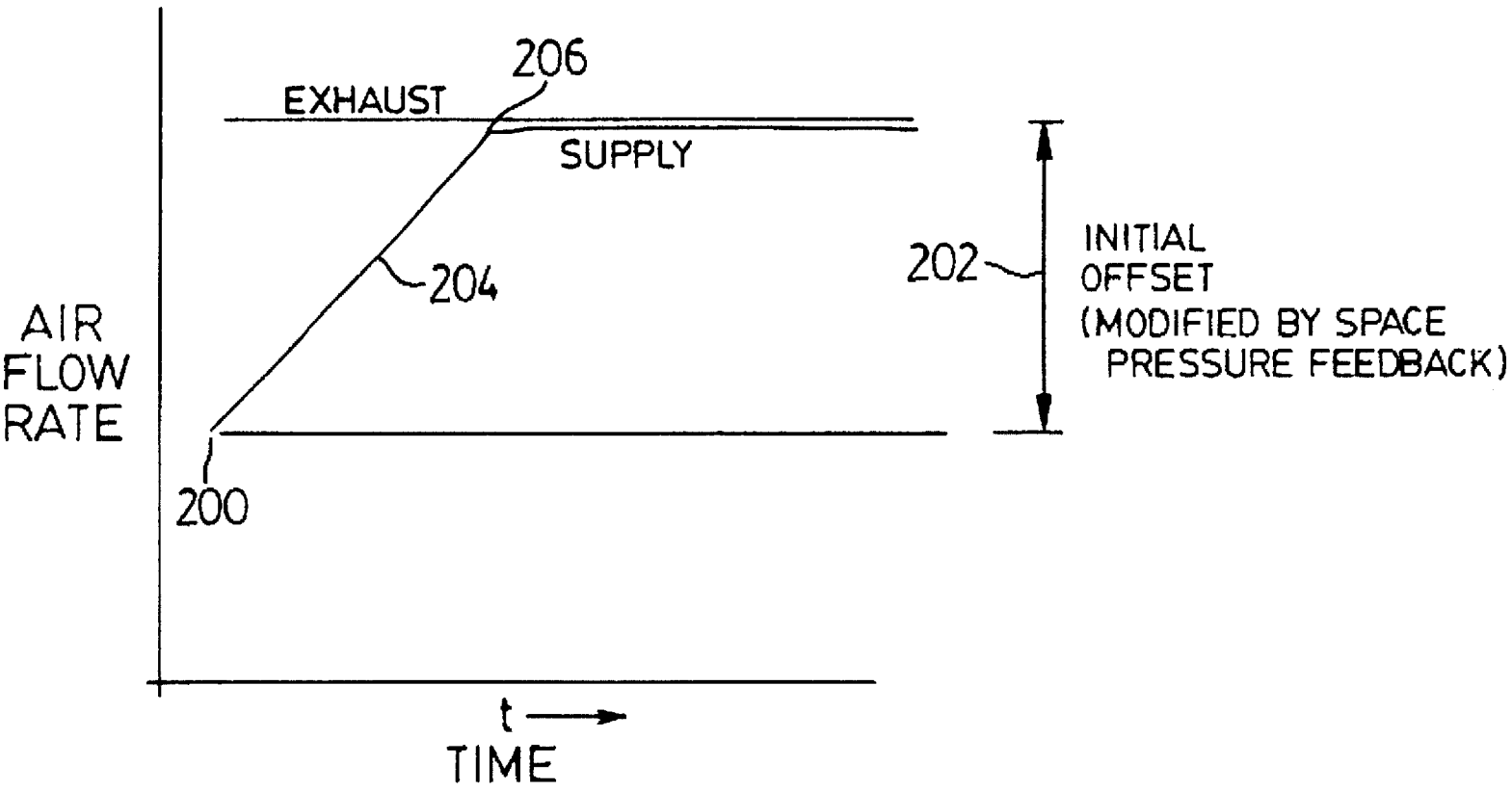
FIG. 2 shows the respective supply air and exhaust air flow rates in response to the variable offset generated by the space pressure controller of FIG. 1.

Referring to FIG. 2, when the supply and exhaust systems 16,18 for the laboratory 12 are first started up (200), the space pressure controller 10 generates an air-flow control signal which will operate the supply air system 16 at a shortfall compared to the exhaust system 18. This is indicated by an offset (202) in the respective supply and exhaust air flow rates. As the negative pressurization in the laboratory 12 reaches the desired level, the space pressure controller 10 decreases the offset (204) between the supply and exhaust air flow. When the desired negative pressurization level has been established, the space pressure controller 10 generates an offset (206) to maintain the negative space pressurization level. The offset (206) should be equal to the leakage rate of the laboratory 12, which in the case of a high containment laboratory is very small.

If the air flows of the supply or exhaust systems 16 or 18 do vary for whatever reason, this will impact on the negative pressure level inside the laboratory space 12. The space pressure controller 10 detects this pressure variation and in response produces an air-flow control signal 64 which will vary the supply air 24 to maintain the desired negative pressure level in the laboratory space 12. The air-flow signal 64 can also compensate for inaccuracies in the air flow measurement and control loops as well as any system disturbances.

It will be appreciated by those skilled in the art that a similar effect can be achieved according to the present invention by keeping the supply air flow rate 24 constant and varying the exhaust air flow rate 32 (see below). The choice of which air flow, i.e. supply air flow 24 or exhaust air flow 32, will usually be determined by factors other than space pressurization.

Reference is next made to FIG. 3 which shows in schematic form the space pressure controller 10 according to the present invention. The space pressure controller 10 achieves and maintains negative space pressure in the laboratory by generating a variable air-flow signal 64 which varies over a predefined schedule or range. The space pressure controller 10, in its simplest form, comprises the differential pressure transmitter 56, a pressure controller 58, a signal limiter 60 (which is optional and shown in broken line outline), and a difference amplifier 62. For the purposes of this explanation, the pressure transmitter 56, the pressure sensing taps 52,53, and the pressure controller 58 (and signal limiter 60, if included) will be termed as a secondary control loop 63.

The differential pressure transmitter 56 is coupled to the space pressure sensing tap 53 (located inside the laboratory space 12) and the reference space sensing tap 52 (typically located in the corridor 54). The space pressure sensing tap 53 detects the space pressure level in the laboratory 12 and produces a pressure level signal (not shown) for the pressure transmitter 56. The pressure transmitter 56 compares the space pressure signal to the pressure level signal produced by the reference pressure sensing tap 52 and generates a difference signal which is fed to the pressure controller 58. The pressure controller 58 produces a variable offset signal 59 which is fed into the signal limiter 60. The signal limiter 60 limits the offset signal 59 to a pre-defined range (see below) to produce an offset control signal 61 which is one of the inputs to the difference amplifier 62. The difference amplifier 62 generates the air-flow control signal 64 by subtracting the offset control signal 61 from an exhaust air flow signal 70 received from the exhaust control interface 50. The exhaust air flow signal 70 is indicative of the exhaust air flow rate 32. The air-flow control signal 64 provides the setpoint for operating the supply air flow controller 34. Because the airflow control signal 64 is generated from the difference between the exhaust air flow signal 70 and the offset control signal 61, the space pressure controller 10 can change the supply air flow rate 24 in response to a change in the exhaust air flow rate 32 or in response to a change in the space pressure level or in response to both.

Alternatively, the differential pressure transmitter 56 can be replaced by a network of absolute pressure sensors (not shown). It will be appreciated by one skilled in the art that this arrangement allows one absolute (barometric) sensor to be located outdoors or in some other reference location and absolute pressure sensors to be located in each room in building. The differential pressure for each space or room can be obtained from a local difference amplifier circuit (not shown). The resulting signal can then be applied to the pressure controller (reference 58 in FIG. 3) in lieu of the single differential pressure transmitter (reference 56 in FIG. 3).

Such an approach has the advantage of providing several levels of negative or positive or mixed pressure levels in the building, all referenced to the reference pressure, without providing a path for leakage of the containments through the sensing tubes that penetrate the barrier wall of the high containment space. This can allow the relative pressure levels to be maintained inside the building, while allowing the building as a whole to be either slightly negative or positive with respect to the reference space. If the reference pressure sensor (e.g. sensing tap 52 in FIG. 1) is located outside the building, allowances for the seasonal pressure variations of the outside air density and the effect of this change on the differential pressure across the building walls, can thus be made automatically, as will be within the capability of one skilled in the art. It will be appreciated that if absolute sensors are to be used, the required resolution must be high with respect to the desired pressure. For an ambient pressure of 100 kPa (kilo-Pascals), the differential pressure will be of the order of 25 Pa (Pascals). Therefore, the resolution of an absolute pressure transducer should be of the order of 0.25 Pa.

Under normal operation, it is typically a requirement that the offset between the supply air flow rate 24 and the exhaust air flow rate 32 equal the leakage rate of the laboratory for the space pressure to remain constant. In a laboratory which approaches "bottle-tight" this means that the supply air flow 24 and exhaust air flow 32 must effectively be equal because the leakage for a bottle-tight laboratory is very small and close to zero. At the desired negative pressure level, the variable offset signal 59 (or offset control signal 61) will correspond to the leakage rate of the laboratory space 12. If the offset between the supply air flow 24 and exhaust air flow 32 are not equal, then the space pressure level for the laboratory 12 will drift from the desired pressure level. The pressure transmitter 56 senses the change in space pressure and the space pressure controller 10 adjusts the offset signal 59 (or 61) until the desired pressure is re-established. In other words, the deviation from the desired space pressure level in laboratory 12 produces an offset control signal 61 which is subtracted from the exhaust air flow signal 70 to produce an air-flow control signal 64 that corresponds to the supply air flow 24 required to establish the desired pressure level.

The pressure controller 58 produces the variable offset signal 59 which varies with and is indicative of the difference in pressure in the laboratory space 12 and the reference space 54. As shown in FIG. 3, the signal limiter 60 can be used to limit the variable offset signal 59 to produce an offset control signal 61 having a defined readjustment range. The range of the limited variable offset signal 61 is defined by a low limit which is set using a potentiometer 67*a* and a high limit which set using a potentiometer 67*b*. The low limit defines the minimum offset between the supply air flow 24 and the exhaust air flow 32, i.e. point 206 in FIG. 2, (because the minimum value of the offset control signal 61 is subtracted from the exhaust flow signal 70). Conversely, the high limit represents the maximum offset between the supply air flow 24 and the exhaust air flow 32, i.e. point 200 in FIG. 2. Since the offset control signal 61 is subtracted from the exhaust flow signal 70, the supply air flow 24 will be less than the exhaust air flow 32 thereby ensuring negative pressurization and containment.

The function of the offset control signal 61 is to produce an air-flow rate which provides sufficient volumetric offset between the supply and exhaust air flow rates 24,32 in order to quickly establish negative pressurization in the laboratory 12 when the space pressure controller 10 is turned on (see FIG. 2). Once negative pressurization is established, the space pressure controller 10 continues to adjust the air-flow signal 64 in order to compensate for variations in the negative pressurization level in the laboratory 12, e.g. due to additional exhaust elements 28 (FIG. 1) being turned on or off, or due to inaccuracies in the system components.

For example, if additional exhaust elements are turned on, the space pressure controller 10 will generate an air-flow signal 64 which increases the set-point of the supply air control system 16 (and the supply air flow 24) until the desired negative space pressure is reestablished. The space pressure controller 10 will modify the offset control signal 61 in response to a change in the negative pressure level. Referring back to FIG. 3, when an exhaust element 28 is turned on the exhaust flow signal 70 will increase, and the air-flow control signal 64 will also change causing a change in the set-point of the supply air system 16. A feature of the present invention is that the combined control of the exhaust air flow 32 and the supply air flow 24 results in a system that impacts minimally on the space pressure level in the laboratory thereby resulting in a more stable and faster responding system. Any resulting change in the space pressurization level in the laboratory 12, will cause the differential pressure transmitter 56 and pressure controller 58 to generate an offset signal 61 which corresponds to the difference between the space pressure in the laboratory 12 and the reference space 54. The offset signal 61 is fed into the difference amplifier 62 which adds or subtracts it from the exhaust air flow signal 70 to produce an air-flow control signal 64 which, if in this example has resulted in a higher than desired space pressure level, will reduce the set point of the supply air controller 34. The resultant reduction in the supply air flow 24 decreases the negative space pressure level in the laboratory 12, until the desired pressure level is re-established. At this point, the differential pressure transmitter 56 and the pressure controller 58 will produce a lower level offset control signal 61 (because the pressure difference appearing through sensing taps 53,55 will be lower). This means that the difference amplifier 62 subtracts less from the exhaust air flow signal 70 (on line 50), thereby increasing the set point and allowing the supply air flow controller 34 to increase the supply or make-up air volume 24 towards the exhaust air volume 32. When the desired negative space pressure level has been attained, the offset signal 61 produced by the pressure controller 58 will approach zero (i.e. equal to the leakage rate of the laboratory 12), and the make-up or supply air 24 will once again equal the exhausted air 32, in the ideal case.

In addition to the signal limiter 60 with the separate high and low potentiometers 67, other variations of the space pressurization controller 10 are possible. For example, known electronic signal filters 72 (shown in broken outline) can be included between the output of the signal limiter 60 and the difference amplifier 62, between the differential pressure transmitter 56 and the pressure controller 58, and mechanical filters in the lines connected to the pressure sensors 52,53 to provide signal averaging and thereby improve system stability.

The space pressure controller 10 depicted in FIG. 3 was described using discrete circuit elements such as operational amplifiers. The space pressure controller 10 can also be implemented by means of a digital computer, which can also be incorporated in a distributed controller hierarchy such as commonly found in the control of modern buildings.

The space pressure controller 10 according to the present invention has the major advantage, of allowing the supply air control system 16 and the exhaust air control system 18 to initially quickly establish negative pressurization by operating in the volumetric offset mode. The volumetric offset control mode allows the exhaust and supply air control systems 16,18 to be operated at high offset levels thereby providing a fast speed of response which can be in the order of one second. Once negative pressurization is achieved in the laboratory space 12, the space pressure controller 10 will use the pressure controller 58 to correct any variations in the space pressurization level or in exhaust and supply flow rates. Because the volumetric mode is used to establish the negative pressurization of the laboratory, the secondary loop 63 comprising the sensing taps 52,53, the pressure transmitter 56 and the pressure controller 58 can have a relatively slow response characteristics which ensures accuracy and stability of operation. However, it will also be appreciated by those skilled in the art that for safe system operation, the sum of all time delays of the supply air flow controller 34, including sampling rates, control loop delays, actuator delays, and the delay in accelerating or decelerating the column of air being moved, should be in the order of less than 2 to 3 seconds.

Once the desired negative pressurization level is established, the secondary control loop 63 need not have a fast response time, since it must only correct for loss of accuracy of the flow measurement (e.g. air flow transmitter 36) and control devices (e.g. air flow controller 34), component drift, and other such parameters in the devices. Since these errors vary slowly with time, their correction is not time critical. By providing system damping, filtering, averaging, or other similar methods (known to those skilled in the art) to eliminate transient conditions, the secondary control loop 63 can be made to be accurate and stable. This is desirable for high containment facilities. Furthermore, even if the containment barrier wall 13 (FIG. 1) of the laboratory 12 is penetrated (e.g. by an explosion or earthquake), as long as the space pressure controller 10 (and supply and air control systems 16,18) have motive power, the space pressure controller 10 can continue to provide containment and ventilation. For example, if a breach in the wall of the laboratory 12 causes the differential pressure to drop to zero (i.e. negative pressure is lost), then the space pressure controller 10 will revert to the volumetric offset method because the space pressure controller 10 will produce a high level offset control signal 61 (which when subtracted from the exhaust flow signal 70 produces an air-flow signal 64 for a low supply air set-point, i.e. the exhaust air volume 32 exceeds the supply air volume 24). This provides a directed air flow which effectively produces a secondary containment level. Another feature of the present invention is that in the volumetric offset mode, the re-pressurization of the laboratory 12 also produces minimal disturbance to the pressurization systems of the other rooms or laboratories in the facility. The secondary control loop 63 will increase the offset signal 61, until such time as it has reached its limit setting. The resultant shortfall of supply air 24 will then be drawn through the breach in the barrier which results in a directed air flow into the containment facility. Because air flow is into the laboratory space 12, the contamination will be contained under the emergency condition.

Another advantage of the space pressure controller 10 according to the present invention appears in the case of supply air or exhaust air system 16,18 failure. In most high containment laboratories, the supply air control system 16 and the exhaust air control system 18 will have two or more supply fans and exhaust fans 30 (FIG. 1) operating in parallel. If, for example, one of the exhaust fans fails, or must be shut down for maintenance, a serious room over pressurization condition will occur unless something is done to quickly reduce the supply air 24 to the laboratories affected by the reduced exhaust air flow 32. For the space pressure controller 10 described above, the supply air flow 24 will need be reduced to unoccupied rooms in known manner, so that the reduced air flow is directed to those rooms which can tolerate it, leaving the critical rooms with the same ventilation levels. It will be appreciated that this operation can greatly improve safety.

Referring back to FIG. 1, the loss of an exhaust fan 30 can be detected by means of a current relay in the motor circuit (not shown) of the exhaust fan 30 which allows the loss of the fan 30 to be determined almost instantaneously. The space pressure controller 10, in each room, can then determine the reduced total exhaust air volume 32, and reduce the air flow through those exhaust devices (using an abnormal system input 31 in FIG. 1) which can tolerate the loss with minimal impact on safety. The reduction produces a new volume of exhaust air (indicated by exhaust signal 70), and the space pressure controller 10 will function to maintain the negative pressurization level as before, except under the new lower volume of exhaust air. Similarly the space pressure controller 10 can respond to abnormal events in the supply air control system 16 by reducing the exhaust air flow to maintain pressurization if both supply and exhaust air flow rates 24,32 can be varied.

In the previous discussion, the space pressure controller 10 established and maintained negative pressurization in the laboratory 12 by controlling the set point of the supply air controller 34. The space pressure controller 10 can be modified to vary the exhaust air flow 32 rate by controlling the exhaust air supply system 18 and keeping the supply air flow 24 rates independently controlled (or constant), using the same principles of operation for the secondary control loop 63 as explained above.

In another aspect of the present invention, the space pressure controller 10 can be modified for use in a high containment laboratory where the supply air flow 24 is variable and where the exhaust air flow 32 is varied to maintain negative space pressure in the laboratory 12, but where the ventilation rates in the laboratory may be changed, say for night or unoccupied periods of time. In this case, the previously fixed air flow may be changed, and the secondary air flows will follow. The modified space pressure controller can be applied to rooms where two or more separate air flow rates are required. This is usually a requirement in high containment applications in case of partial failure of either the supply or exhaust air control systems. The exhaust air system 18 may consist of multiple exhaust sources, some of which may be individual exhaust fans, or the main exhaust fan system may consist of two or more exhaust fans operating at the same time, and some may be on standby duty. If any of these exhaust fans fail, due to a motor burn-out or for some other reason, the exhaust air volume from the room will be affected. If no provision is made to reduce the ventilation level (in that room), then in those rooms closest to the exhaust fan, the fan will continue to draw the same amount of air as with all fans operating, and the other rooms attached to the same duct, may be starved for air. It is a requirement to predetermine how the reduction in air will affect each lab. Therefore, it is usually a requirement to be able to vary the ventilation levels in all laboratory rooms.

Reference is next made to FIG. 4 which shows another implementation of the space pressurization space pressure controller 10 according to the present invention. (In FIG. 4, like elements from FIG. 1 are indicated by the same reference numbers.) The space pressure controller 10 (of FIG. 3) has been combined with a make-up air control panel 75, e.g. the MAC 300 series which is manufactured by Phoenix Controls Corporation. The space pressure controller/make-up air panel is denoted by reference 100. The supply air control system 16 and the exhaust air control system 18 comprise "controllable air flow venturi" (CAFV) devices 76,78 respectively. Suitable commercially available components for devices 76,78 include the EXV or MAV Series control valves which are manufactured by Phoenix Controls Corporation. The supply air control system 16 is coupled to the space pressure controller/panel 100 through the control interface 40 which includes lines 77 and 81 for controlling and monitoring the operation of the supply air flow venturi device 76. Similarly, the exhaust air control system 18 is coupled to the space pressure controller/panel 100 through the control interface 50 which includes lines 79 and 83 for controlling and monitoring the operation of the exhaust air flow venturi device 78 for the exhaust system 18.

Referring still to FIG. 4, the space pressure controller/panel 100 is also coupled to a general exhaust valve which comprises a "controllable air flow venturi" device 104. The exhaust valve 104 couples an exhaust vent 102 to the exhaust ducting 26 (through an exhaust duct 106). The general exhaust valve 104 and vent 102 provide exhaust ventilation for the laboratory 12 which is independent of the exhaust elements 28.

In this embodiment of the present invention, the space pressure controller/panel 100 uses the exhaust valve 104 to control the space pressure level in the laboratory 12. Since the general exhaust valve 104 is typically smaller than the valve 78 employed in the exhaust system 18, more precise control of the space pressure level in the laboratory 12 is possible. The general exhaust valve 104 is coupled to the space pressure controller/panel 100 through a control interface 108 which includes lines 109,111 for controlling and monitoring the operation of the valve 104 in known manner.

The panel 75 is modified according to the present invention to accept the offset control signal 61 (FIG. 3) in lieu of the constant offset signal which is used for a low containment application. The installation and operation of the Phoenix Controls equipment is described in an Application and Design Guide which is available from Phoenix Controls. The space pressure controller and make-up air control panel 100 is shown in more detail in FIG. 5.

Referring to FIG. 5, the make-up air controller 75 consists of standard circuit elements. For example, the panel 75 includes a P/E module 80 which is a standard pressure to electric transducer to convert a pneumatic thermostat signal to an electric or electronic signal. If the thermostat output signal is electronic, then this transducer would not be required. The panel 75 also includes scaling function modules f(sc) 82, f(o) 86 and a high signal selector module f(hi) 88. The scaling modules 82,86 usually comprise an operational amplifier with adjustable zero and range, and the high signal selector 88 can comprise known diode or operational amplifier based circuits. The make-up air panel 75 also includes first and second summing elements **84*a* and 84*b*. The first summing element 84*a* is coupled to the scaling module f(o) 86, and is used to sum the exhaust flow rates (e.g. on line 79 from the valve 78) of the exhaust elements for the laboratory 12. The output from the summing element 84*a* represents the total exhaust flow rate for the laboratory 12. The exhaust flow rate is scaled by module f(o) 86 and used to control the supply valve 76 (through the high signal selector module f(hi) 88 and control line 77**).

Referring still to FIG. 5, the second summing element **84*b* is used to control the general exhaust valve 104 and space pressurization of the laboratory 12. The summing element 84*b* produces an output signal which is the difference between the exhaust air flow rate (i.e. output of the scaling module f(o)) and the supply air flow rate (i.e. from line 81). As shown in FIG. 5, the space pressure controller 10 (of FIG. 3) is Coupled to the output of the summing element 84*b*. The offset control signal 61 is subtracted from the output (of the summing element 84*b*) by the difference amplifier 62 which produces the set-point signal for the general exhaust valve 104 on control line 109 to maintain space pressurization as explained above. In the configuration shown in FIG. 5, the exhaust valve 104 operates as a normally open valve. If the exhaust valve 104 is normally closed, then the difference amplifier 62 would be replaced by a summing element which would generate the control signal on line 109**.

The systems shown in both FIGS. 1 and 4 can be further modified to include a temperature controller which in known manner can be coupled to the supply duct 32 and a terminal reheat coil in the HVAC equipment 20. In this aspect, the space pressure controller 10 can maintain the temperature in the laboratory space 12 as well as maintaining a minimum ventilation level and space pressure in the laboratory 12. In known manner, the temperature controller sequences the reheat coil valve (for heating) with additional air from the primary air supply system (for cooling). It will be appreciated that such a configuration normally requires a general exhaust valve from the laboratory space 12. The space pressure controller 10 will not allow the supply air 24 to drop below the minimum desired ventilation levels. If more supply air 24 is required for cooling than necessary for maintaing the desired space pressure level, the space pressure controller 100 (FIGS. 4 and 5) will automatically decrease ("bleed") the excess pressure using the general exhaust valve 104 (FIG. 4). If additional heat is required, then the space pressure controller 10 will add reheat. This type of control system is suitable for use with an supply air system usually referred to as a "Reheat System". Similarly, the space pressure controller 10 can be modified for use with other available supply air systems such as the dual duct system.

The pressure controller 58 (shown in FIG. 3) may be adjusted to provide a scheduled override for the variable offset signal 59. Normally this override schedule is not limited to the indicated pressure values. Rather it determines a straight line relationship, that is then allowed to continue from (theoretically) minus infinity to plus infinity. Of course, other system parameters limit the adjustment range to something more finite. If however, the override must be limited to set limits, then limiting circuits (e.g potentiometers 67 shown in FIG. 3) can be used.

As will be appreciated by one skilled in the art there are applications where several fixed adjustment ranges for the offset signal 55 may be useful. In a high containment laboratory operating normally, one set of limits may be desirable. However, if an emergency exit door leading to another containment level space is opened, another adjustment range may be desirable. Thirdly, if an explosion or fire has been sensed, a third adjustment range may be desirable.

Each one of the different adjustment ranges may be sensed by a sensor whose output is an electrical contact. This contact can then switch the desired adjustment range on the high or limit inputs of the limit circuit.

An example space pressure override schedule for illustration purposes could be as follows. Assume that the ventilation system is designed to provide ventilation rates at 500 Liters per second and that the desired (negative) space pressurization of −25 Pa has already been established. If at some point in time, the space pressure is measured at −15 Pa with respect to a reference pressure (usually the corridor), the control space pressure controller 10 will increase the exhaust air flow by a maximum of 25 L/sec to compensate for lack of accuracy of the measuring system or to compensate for leakage (due to a temporary opening of a door). Similarly, when the space pressure is measured at −35 Pa, the control space pressure controller 10 will reduce the exhaust air flow by a maximum of 25 L/sec (from the design level of 500 L/sec) in order to bring the space pressure back down to the design level. The adjustment schedule can be set up, in this example, to provide an exhaust air flow adjustment of (+25 L/sec to −25 L/sec) 50 L/sec over a measured differential pressure range of (−15 Pa to −35 Pa) −20 Pa. Therefore the adjustment range is 2 L/sec per (negative) Pa change in space pressure. In some applications, this limited adjustment may be desirable; in others it may not, as will be understood by one skilled in the art.

It will be evident to those skilled in the art that other embodiments fall within the scope of the present invention as defined by the following claims.

I claim:

1. A system for controlling space pressure in a room at a predetermined level with respect to a reference space, said system comprising:

(a) volumetric air flow control means for controlling air flow to and from the room and including means for setting the air flow level;

(b) said volumetric air flow means having means for generating an offset in said air flow level to produce a predetermined space pressure level in the room;

(c) differential pressure control means for sensing a change in said space pressure level and generating a control signal having a value corresponding to the change in said space pressure level, and said differential control means being coupled to said volumetric air flow control means and forming a control loop for said volumetric air flow control means; and (d) said means for generating an offset having means responsive to said control signal for adjusting the offset in said air flow level for restoring the space pressure in the room to said predetermined level.

2. The system as claimed in claim 1, wherein said volumetric air flow control means includes means for generating an abnormal condition control signal for providing an offset level for operating said volumetric control means at an increased containment level.

3. The system as claimed in claim 1, further includes setback means for producing a setback air flow level, said means for generating an offset in said air flow level being responsive to said setback air flow level to produce a space pressure level in the room corresponding to said setback air flow level.

4. The system as claimed in claim 1, wherein said differential pressure control means includes means for producing a reference pressure signal corresponding to the space pressure in a reference space and means for producing a space pressure signal corresponding to the space pressure level in the room, and said control signal being dependent on the difference between said reference pressure signal and said space pressure signal.

5. The system as claimed in claim 4 wherein said reference space comprises a space exterior the building containing the room.

6. The system as claimed in claim 4, wherein said differential pressure control means comprises a pressure controller and a pressure transmitter having an input for said reference pressure signal and an input for said space pressure signal and means for producing an output signal corresponding to the difference between said reference pressure signal and said space pressure signal and said pressure controller having means for receiving said output signal and generating said corresponding control signal.

7. The system as claimed in claim 6, wherein said means for generating an offset in said air flow level provides a setpoint for controlling flow of supply air to the room.

8. The system as claimed in claim 6, wherein said means for generating an offset in said air flow level provides a set point for controlling flow of exhaust air from the room.

9. The system as claimed in claim 2, wherein said volumetric air flow control means includes an input for receiving an external signal indicative of an abnormal condition and means for generating said abnormal condition control signal in response thereto.

10. A method for controlling space pressure in a room, said method comprising:

(a) providing an air flow at a selected level for the room;

(b) generating an offset in said air flow level until a predetermined space pressure is established for the room;

(c) detecting a change in said established space pressure with respect to a reference pressure;

(d) generating a variable offset which varies with said detected change in said space pressure; and (e) applying said variable offset to said offset in said air flow level to restore said predetermined space pressure level.

11. The method for controlling space pressure as claimed in claim 10, further including the step of generating an abnormal condition offset for producing an air flow level for increased containment.

12. The method for controlling space pressure as claimed in claim 10, wherein said step (a) comprises providing an exhaust air flow at a predetermined level and a supply air flow at a level which is variable in response to said offset and said variable offset.

13. The method for controlling space pressure as claimed in claim 10, wherein step (b) comprises operating a supply air flow to said room at a level less than an exhaust air flow to said room and said level corresponding to said offset.

* * * * *